United States Patent [19]

Armstrong

[11] Patent Number: 4,458,596

[45] Date of Patent: Jul. 10, 1984

[54] MULTI-PURPOSE BOMBLET

[75] Inventor: Stanley Armstrong, Springville, Ind.

[73] Assignee: The United States of America as represented by the Secretary of the Navy, Washington, D.C.

[21] Appl. No.: 395,567

[22] Filed: Jul. 6, 1982

[51] Int. Cl.[3] ..... F42B 25/14; F42B 25/16

[52] U.S. Cl. ..... 102/389; 102/364; 102/393; 102/493

[58] Field of Search ..... 102/394, 393, 389, 364, 102/476, 493

[56] References Cited

U.S. PATENT DOCUMENTS

| | | | |
|---|---|---|---|
| 1,237,012 | 8/1917 | Barlow . | |
| 1,791,716 | 2/1931 | Davis et al. . | |
| 2,586,801 | 2/1952 | Epler et al. | 102/6 |
| 2,737,114 | 3/1956 | Hershberg | 102/6 |
| 2,741,177 | 4/1956 | Ricards, Jr. et al. | 102/6 |
| 2,959,127 | 11/1960 | Weinert | 102/65 |
| 3,296,967 | 1/1967 | Bounds et al. | 102/6 |
| 3,808,972 | 5/1974 | Cammack et al. | 102/394 |
| 3,893,814 | 7/1975 | McGhee | 102/364 |
| 3,968,748 | 7/1976 | Burford et al. | 102/394 |
| 4,318,343 | 3/1982 | King | 102/365 |
| 4,381,692 | 5/1983 | Weintraub | 102/364 |

*Primary Examiner*—Charles T. Jordan

*Attorney, Agent, or Firm*—Robert F. Beers; Paul S. Collignon

[57] ABSTRACT

A multi-purpose bomblet is designed for accomplishing various military missions. A standoff spike and shaped charged are provided for piercing heavy armor and a fragmentation case surrounds the shaped charge. Upon detonation of the shaped charge, the fragmentation case disintegrates to provide shrapnel which is effective against personnel. An inner liner of incendiary material also surrounds the shaped charge and, upon detonation of the shaped charge, the incendiary material is ignited and dispersed and is useful for starting fires.

2 Claims, 4 Drawing Figures

MULTI-PURPOSE BOMBLET

BACKGROUND OF THE INVENTION

The present invention relates to bomblets, and more particularly to a bomblet which can be effectively used for different purposes, such as against tanks, against personnel and for starting fires.

Some types of bombs, missiles and other weapons are presently designed to accomplish a particular mission. For example, some are made to penetrate heavy armor, some are designed to start fires and some are intended to be used against troops. There are several disadvantages to a speciality bomb, one being that when loaded onto an aircraft, it may be necessary to unload the speciality bomb if a different mission is assigned. Another disadvantage of special purpose bombs is that multiple inventories need to be maintained thus increasing production cost and storage cost.

SUMMARY OF THE INVENTION

The present invention relates to a multi-purpose bomblet which can be effectively used agsinst hard targets, such as tanks or armored vehicles, against personnel, and for starting fires. A plurality of bomblets are carried in a container which is designed for air-drop and which opens to dispense the bomblets while still in the air. Each bomblet has a standoff spike and a shaped explosive charge which provide armor-piercing capability. A fragmentation case surrounds the shaped explosive charge and, upon detonation of the shaped explosive charge, the fragmentation case breaks into small particles which act as small missiles against personnel. An inner liner of incendiary material, such as zirconium, also surrounds the shaped explosive charge and, upon detonation of the shaped explosive charge, the inner liner is fragmented and set afire and these burning fragments are intended to start fires.

It is therefore a general object of the present invention to provide a multi-purpose bomblet which can be used for various military missions.

Other objects, advantages and novel features of the present invention will become apparent from the following detailed description of the invention when considered in connection with the accompanying drawing.

DESCRIPTION OF THE PREFERRED EMBODIMENT

Figure 1:
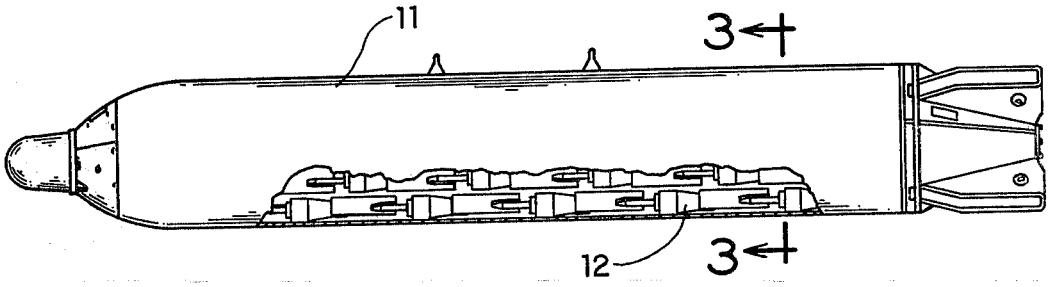
FIG. 1 is a side view, partly broken away, of a cluster bomb.
Figure 3:
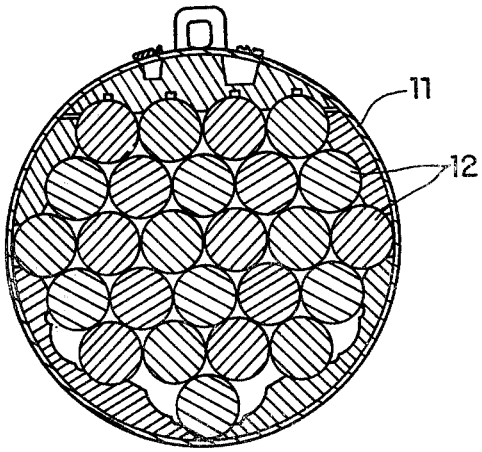
FIG. 3 is a sectional view taken on line 3—3 of FIG. 1.

Referring first to FIGS. 1 and 3 of the drawing, there is shown a cluster bomb 11 having a plurality of bomblets 12 therein. By way of example, cluster bomb 11 might be an unguided, free-fall bomb which is carried by an aircraft. After cluster bomb 11 is released from an aircraft, it is opened to dispense the bomblets 12.

Figure 2:
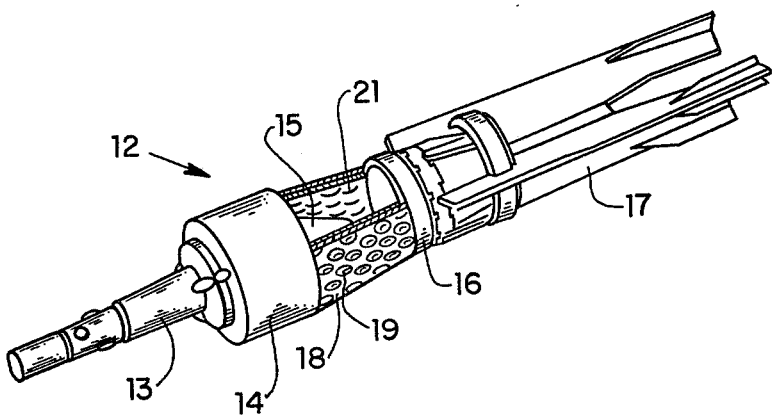
FIG. 2 is an isometric view, partly broken away, of a bomblet.
Figure 4:
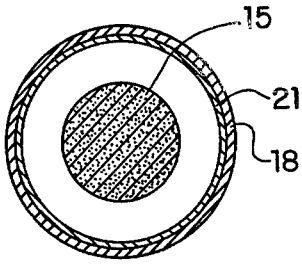
FIG. 4 is a sectional view of the bomblet shown in FIG. 2.

Referring now to FIGS. 2 and 4, there is shown an improved bomblet 12 which is the subject of the present invention. Bomblet 12 is comprised of a standoff spike 13 attached to a body 14 and a shaped explosive charge 15 is positioned inside body 14. A fuse assembly 16 is provided in the aft end of the bomblet and a tail fin 17 is attached to the outer aft end. A controlled fragmentation case 18 is provided around shaped explosive charge 15 and between body 14 and fuze assembly 16. By way of example, fragmentation case 18 might have a plurality of dimples 19 of reduced thickness so that, upon detonation of shaped explosive charge 15, case 18 will shatter or explode into a multiple number of small projectiles. A liner 21 of incendiary material, such as zirconium, is fitted inside case 18, and liner 21 is also dimpled, serrated, or otherwise designed so that it will disintegrate into a multiple number of burning fragments upon detonation of shaped charge 15. By way of example, the thickness of liner 21 might be between about 0.060 and 0.080 inch.

OPERATION

In operation, cluster bomb 11 is dropped from an aircraft and, during free-fall, bomblets 12 are dispersed. Bomblets 12 are primarily designed to destroy hard targets, such as tanks, armored vehicles, and guns, and standoff spike 13 provides a separation between the hard target and the rest of the bomblet. Upon detonation of shaped explosive charge 15, bomblet 12 will pierce a hard target and is capable of penetrating 8 inches of hard armor.

In the event that the designated target might be personnel, the explosion of bomblet 12 causes case 18 to fragment and a multiple number of projectiles are dispersed. Also, explosion of liner 21 causes a multiple number of burning fragments to be dispersed and will start fires. These burning fragments are well-suited for igniting fuel and ammunition depots.

It can thus be seen that the bomblet described will have multi-purpose use in that it can be used against hard targets, against personnel and for incendiary purposes.

Obviously many modifications and variations of the present invention are possible in the light of the above teachings. It is therefore to be understood that the invention may be practiced otherwise than as specifically described.

I claim:

1. A multi-purpose bomblet comprising, a housing having a standoff spike on one end and a tail fin on the other end, a shaped explosive charge within said housing, a fragmentation case surrounding said shaped explosive charge, said fragmentation case being characterized by a plurality of dimples of reduced thickness, whereby said case is adapted to disintegrate into a multiplicity of projectiles upon detonation of said shaped explosive charge, an inner liner of incendiary material positioned between said shaped explosive charge and said fragmentation case, said liner also being characterized by dimples of reduced thickness, whereby said incindiary liner is adapted to fragment into a multiplicity of burning fragments upon detonation of said shaped explosive charge; and a fuze assembly for detonating said shaped explosive charge.

2. A multi-purpose bomblet as set forth in claim 1 wherein said inner liner is zirconium and has a thickness in the range of about 0.060 to 0.080 inch.

* * * * *